US006289952B1

(12) United States Patent
Jones et al.

(10) Patent No.: US 6,289,952 B1
(45) Date of Patent: Sep. 18, 2001

(54) PIN ROUTER

(75) Inventors: Steve K. Jones, Nepean; Edwin C. Tucker, Ottawa, both of (CA)

(73) Assignee: Lee Valley Tools Ltd., Ottawa (CA)

( * ) Notice: Subject to any disclaimer, the term of this patent is extended or adjusted under 35 U.S.C. 154(b) by 0 days.

(21) Appl. No.: 09/348,197

(22) Filed: Jul. 6, 1999

(51) Int. Cl.[7] ..... B27C 5/02

(52) U.S. Cl. ..... 144/135.2; 144/371; 144/134.1; 409/110

(58) Field of Search ..... 409/97, 110, 184, 409/218; 144/134.1, 135.2, 136.95, 371

(56) References Cited

U.S. PATENT DOCUMENTS

| | | | | |
|---|---|---|---|---|
| 554,333 | * | 2/1896 | Cook | 409/110 |
| 4,484,608 | | 11/1984 | Ferdinand et al. . | |
| 4,537,234 | * | 8/1985 | Onsrud | 144/135.2 |
| 4,779,327 | | 10/1988 | Vander Maas . | |
| 4,893,661 | * | 1/1990 | Onsrurd | 144/135.2 |
| 5,025,841 | * | 6/1991 | Totten | 144/135.2 |
| 5,345,984 | | 9/1994 | Ardesson . | |

OTHER PUBLICATIONS

Pages (3) printed from C.R. Onsrud's Website (http://www.cronsrud.com/page 5.html) related to the 2003 C.R. Onsrud Inverted Router, Jun. 29, 1999, admitted to be prior art.

Pages (3) printed from C.R. Onsrud's Website (http://www.cronsrud.com/page4.html) related to the 3025 C.R. Onsrud Inverted Router, Jun. 29, 1999, admitted to be prior art.

Pages (4) printed from C.R. Onsrud's Website (http://www.cronsrud.com/page3.html) related to the 36210 C.R. Onsrud Inverted Router, Jun. 29, 1999, admitted to be prior art.

Pages (3) printed from C.R. Onsrud's Website (http://www.cronsrud.com/page2.html) for general information regarding the C.R. Onsrud Inverted Router, Jun. 29, 1999, admitted to be prior art.

* cited by examiner

*Primary Examiner*—W. Donald Bray
(74) *Attorney, Agent, or Firm*—John S. Pratt; Kilpatrick Stockton LLP

(57) ABSTRACT

A pin router arm for attachment to a router table, and a mechanism that attaches to a plunge router to conveniently and accurately move the router body relative to the router base in order to adjust the position of a router bit in the router relative to the router table. Substantial excursions in router bit position are made by moving a handle up or down using a handle or a foot pedal, and small excursions are made using a micro-adjust mechanism that has a detent set screw and cooperating structure to facilitate adjustment of the micro-adjust mechanism by very small predetermined increments. The pin router arm can hold interchangeable sizes of guide pins and is easily and quickly mounted on and removable from the router table.

7 Claims, 7 Drawing Sheets

PIN ROUTER

FIELD OF THE INVENTION

This invention relates to router tables, pin routing machines and mechanisms for positioning router bits, particularly bits used in plunge routers mounted in router tables.

BACKGROUND OF THE INVENTION

Adjusting the height of a router bit when the router is fixed in a table is frequently difficult. Doing so is particularly difficult when using a plunge router because a plunge router is not well designed for making small adjustments in the projection of the router bit by moving the router body relative to the base. Furthermore, plunge routers are designed to be used upright, and they typically include springs that balance the router weight so that the router body will not drop uncontrollably toward the base when the body and base are unlocked. When the router is upside down in a router table, the router body and base are urged apart from each other by the force of gravity and/or springs, introducing further grief in achieving desired adjustments in bit location.

Many plunge routers have a threaded adjusting rod attached to the router base and passing through or adjacent to a ledge or other structure that is part of, or is attached to, the router body. A nut or pair of locking nuts positioned on this adjusting rod and bearing against the ledge serves to fix the position of the router base relative to the body. Aftermarket devices for adjusting the position of the base are available in which an internally threaded nut is attached to one end of a tube and a knob is attached to the other to tube end (where the knob is sufficiently clear of the router body to be readily accessible, at least when the router is an upright position). The nut is threaded onto the adjustment rod, and rotation of the knob rotates the nut around the rod and against the ledge. The knob on such devices can be relatively inaccessible, however, when the router is mounted under a router table, and its rotation moves the router body relative to the router base too slowly when substantial changes in router bit position are being made but too quickly for truly accurate adjustments because of the typically coarse pitch of the adjusting rod thread.

As a result, there is a substantial need for a mechanism for securing and conveniently and accurately adjusting the position of a plunge router when it is mounted upside down in a router table so that the projection of the router bit above the table can be closely controlled.

One of the many attractive capabilities of a router is its ability to be used with a pattern to accurately and quickly manufacture multiple parts corresponding to the pattern. In some instances, this is possible utilizing a router bit with an attached ball bearing follower that bears against the pattern. Some products cannot be made, however, with such a pattern following bit. For instance, such bits cannot be used to form a hollow area within a workpiece using a cove cutter. This type of operation can be done with a pin routing machine, which is typically a dedicated tool like that depicted in U.S. Pat. No. 4,893,661.

An attachment has been suggested in order to provide a router table with pin router capability in U.S. Pat. No. 5,345,984, but that design suffers from several practical limitations. Additionally, the full benefit of pin routing capabilities can be achieved only if it is possible to raise the cutter into the workpiece. Accordingly, there is a continuing need for practical pin router apparatus usable with a router table and a conventional fixed base or plunge base cabinet shop router.

SUMMARY OF THE INVENTION

This invention is a mechanism that moves a tool or a portion of it relative to another portion of the tool or other structure. The mechanism attaches to a plunge router, particularly when the router is used in a router table, to conveniently and accurately move the router body relative to the router base and lock the two in desired relative positions so that the adjustment of the position of a router bit relative to a router table may be also be accomplished conveniently and accurately. The mechanism is attached to the router base and bears against a ledge or other portion of the router body so that the body and base can be drawn toward each other or permitted to separate from each other.

In the embodiment of the invention described below, this is accomplished by attaching a plunger or piston to a threaded adjustment rod that is attached to the router base. (Such threaded rods are typically supplied with plunge routers). The piston is positioned to slide within a cylindrical opening or sleeve within a mechanism body. The position of the piston, and therefore the position of the router body relative to its base, is controlled for relatively coarse position adjustments by a pivoting handle and, for fine adjustments in position, by a micro-adjust mechanism positionable in the bottom or lower end of the body. The micro-adjust mechanism utilizes a threaded spindle that may be moved axially by very small increments by rotating a knob on the lower end of the spindle. The piston rests on the top of the spindle and, therefore, is raised and lowered by the same small increments of axial movement of the spindle.

The mechanism body is an elongated sleeve having a cross-sectional shape similar to the letter Omega (Ω). The piston travels within a generally cylindrical passage in the body adjacent to an elongated groove defined by two parallel plates protruding from one side of the body. One end of the handle is positioned between the plates and pivots on a stud or screw that extends through the plates. The handle is attached by links to a piston arm that slides between the plates and within the groove and attaches to the piston. The handle may also be attached by a chain, rod or other link to a foot pedal so that changes in the position of the router body relative to its base may be made without use of the operator's hands. By providing multiple positions at which the link to the piston may be attached to the handle, the position of the handle (for a particular router bit position), and the excursion of the handle necessary to move the piston a particular distance, may be adjusted. Multiple attachment points on the handle for the chain, rod or other link to the foot pedal also make possible adjustment of the pedal excursion (for a particular range of bit movement). Such multiple attachment points also make it possible to adjust the force necessary to achieve a particular bit movement, since the mechanical advantage can be varied. Generally a relatively large handle excursion will result is a relatively small bit movement so that relatively little force is needed and a desired bit location is easy to achieve.

Each of the piston and the micro-adjust cylinder that are positioned within the cylindrical passage in the mechanism body may be locked in the body by squeezing it closed utilizing any of a variety of mechanisms for doing so, such as threaded studs or screws operated by knobs or handles to draw the plates toward each other.

The pin router fixture of this invention is a casting having a foot that rests on a router table top and that is either bolted to the top or clamped to it. The casting rises from the table and gracefully curves toward the center of the table, where it terminates in a sleeve with a vertical bore that is centered above the router. The sleeve captures a guide pin mechanism that holds a selected size of interchangeable guide pins directly above the axis of rotation of the router cutter or bit. The mechanism permits the guide pin to be raised up and held in a raised position or dropped down to a lower, operational position, and held there with the assistance of a spring. The entire guide pin mechanism may be raised or lowered to position the guide pin as desired.

Clamping blocks used to clamp the pin router arm to the router table, particularly a thin top such as a sheet steel one, are adjustable so that, once adjusted for a particular router table top, the pin router arm may be removed and replaced quickly and accurately.

Simultaneous use of the pin router arm and adjustment mechanism of this invention with a conventional plunge router and router table top make it possible to achieve the capabilities of a conventional pin router. This includes the ability to cut an internal depression in a workpiece such as might be done in the course of making a shallow bowl or tray.

DETAILED DESCRIPTION OF THE DRAWINGS

Bit Positioning Mechanism

Figure 1:
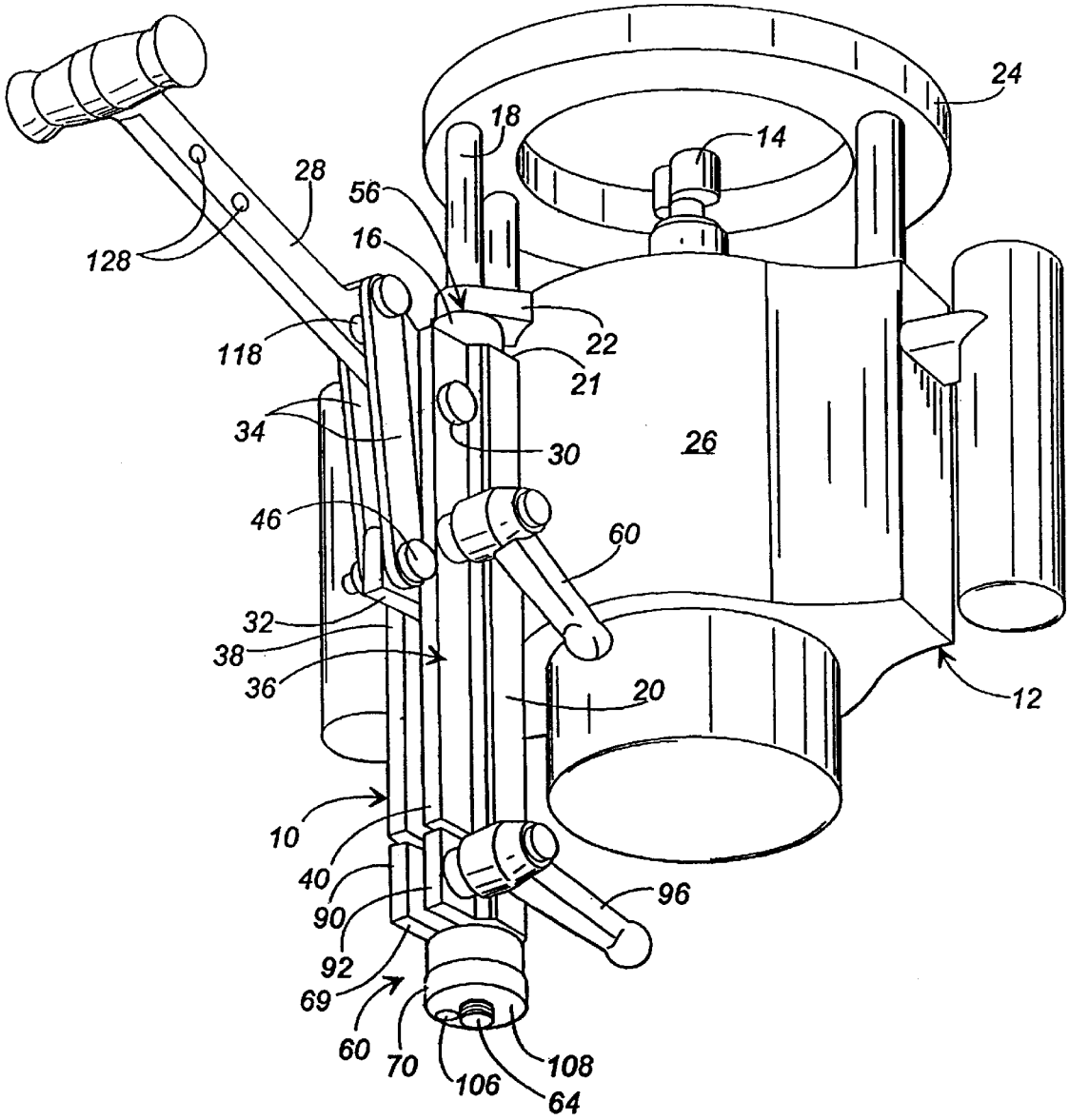
FIG. 1 is a perspective view of the router bit positioning mechanism of this invention shown in position on a plunge router oriented upside down as it would be when mounted in a router table (not shown).

The router bit positioning mechanism of this invention is described in U.S. Pat. No. 5,918,652, issued Jul. 6, 1999, which is incorporated herein by this reference. As is illustrated in FIG. 1, the router bit positioning mechanism 10 of this invention is attached to an electric router 12 having a bit or cutter 14. The mechanism 10 attaches to plunge router 12 by threading piston 16 onto the threaded adjust rod 18 on router 12. Threaded rods like rod 18 are present on most plunge routers; typically one or two nuts threaded onto such a rod 18 may be positioned on the rod 18 to contact a ledge 22 attached to or a part of the router body 26. This contact limits the retraction of router body 26 from router base 24 when the base 24 is not locked and gravity or springs (not in the router 12 force the router body 26 and base 24 apart. When the router 12 is used upside down in a router table, the weight of the router body 26 alone is typically adequate to urge the body 26 down away from the base 24. Consequently, it is often desirable to remove the springs when using a router 12 in a router table with mechanism 10.

The top 21 of body 20 (within which body 20 piston 16 travels) bears against ledge 22 through which adjust rod 18 of router 12 passes. Thus, drawing piston 16 into body 20 draws adjust rod 18 through ledge 22 while the top 21 of body 20 presses against ledge 22 on router body 26, thereby causing the router body 26 to move toward router base 24. This causes router bit 14 to project through base 24 and through the router table (not shown) to which base 24 is attached.

Figure 2:
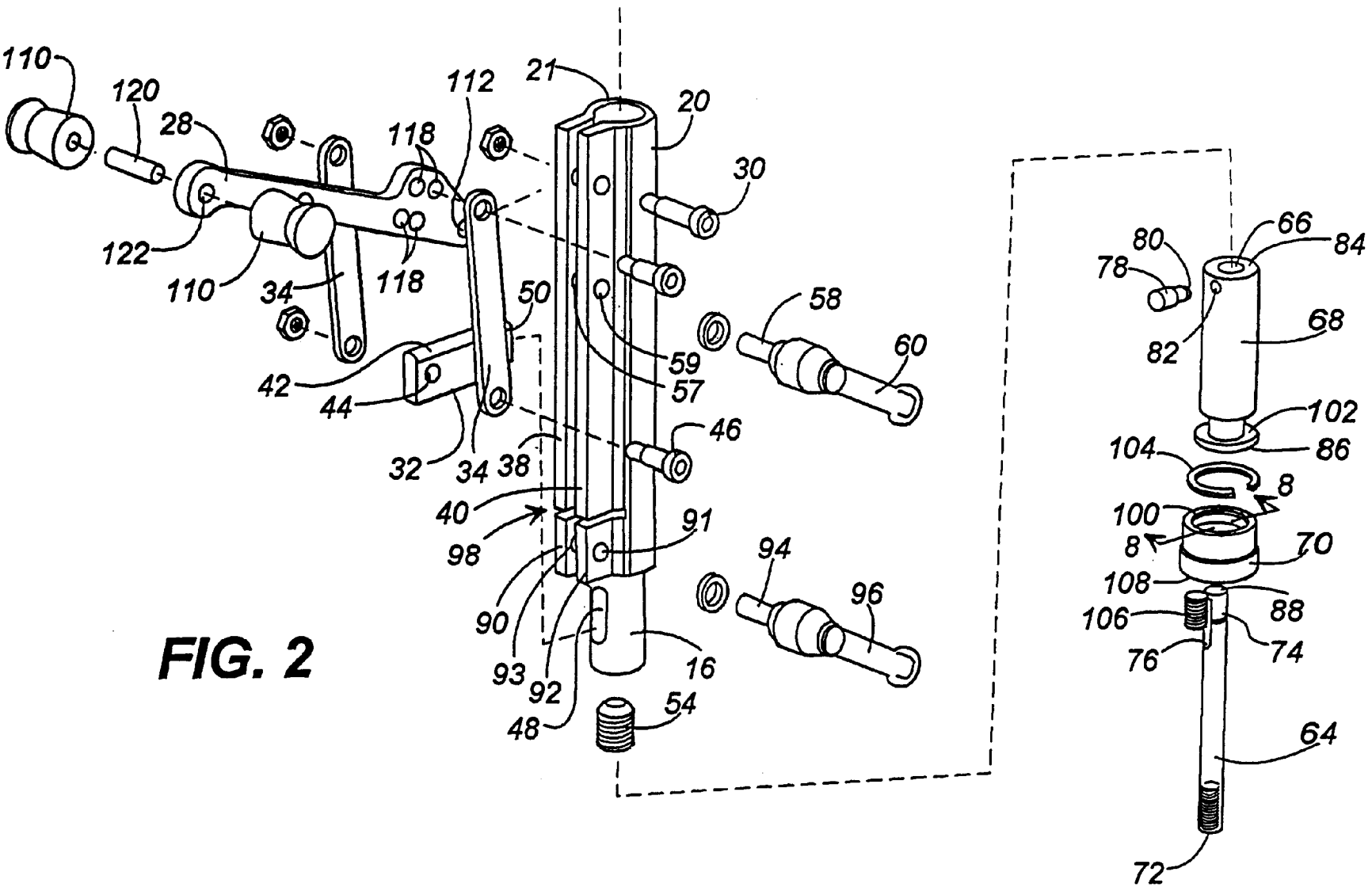
FIG. 2 is an exploded perspective view of the router bit positioning mechanism shown in FIG. 1.

As will be appreciated by reference to FIGS. 1 and 2, relatively substantial adjustments in the position of piston 16 within body 20 (and thus in the position of bit 14) are made by manipulating handle 28 up and down. Handle 28 pivots on shoulder screw 30 and is coupled to piston arm 32 by links 34. Piston arm 32 slides within a groove 36 defined generally by parallel plates 38 and 40 that project from body 20. Piston arm 32 is a generally rectangular plate, preferably having one rounded edge 42 and a hole 44 near one end of the arm 32. A link attaching screw 46 passes through hole 44 to attach links 34 to piston arm 32. The end 50 of piston arm 32 remote from hole 44 is received in a slot 48 near the lower end 52 of piston 16.

The lower end 52 of piston 16 is internally threaded to receive a set screw 54. When the end 50 of piston arm 32 is inserted in slot 48 of piston 16, set screw 54 is tightened against piston arm 32, forcing the upper edge 42 of piston arm 32 against the wall of slot 48, thereby locking it in position.

The upper end 56 of piston 16 is also internally threaded so that it may be threaded onto adjust rod 18 of router 12. Thread pitch and diameter in the upper end 56 of piston 16 must, of course, be matched to the thread pitch and diameter of adjust rod 18 supplied with the particular router 12 being used.

Bit positioning mechanism 10 is mounted on router 12 by first threading piston 16 onto adjust rod 18 and then sliding piston 16 into body 20, after which piston arm 32 is attached to piston 16 as is described above.

Piston 16 may be locked within body 20 by drawing plates 38 and 40 together, thereby squeezing body 20 tightly around piston 16. This may be accomplished by tightening locking stud 58 with gyratory handle 60 (which might also be a generally round or Tee-shaped knob secured to stud 58). Stud 58 passes through a smooth bore 59 in plate 40 and into a threaded bore 57 in plate 38.

Figure 4:
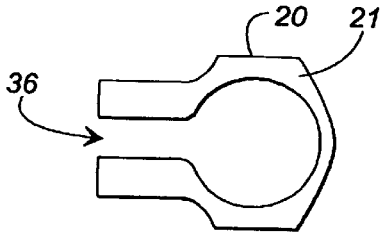
FIG. 4 it is a top plan view of the body of the positioning mechanism shown in FIG. 1.

Body 20 may be extruded aluminum and can be anodized for reduced friction and enhanced wear-resistance. It may have the cross-sectional shape shown in FIG. 4 and visible at the top of body 20 in FIG. 2.

Fine adjustments in the router bit 14 position may be made utilizing a micro-adjust mechanism 60 that is positioned in and below lower end 69 of body 20. Micro-adjust mechanism 60 includes a spindle 64 positioned in a smooth bore 66 in a generally cylindrical micro-adjust body or cylinder 68. The position of spindle 64 within micro-adjust cylinder 68 is established by adjusting knob 70, which is threaded onto the lower, externally threaded end 72 of spindle 64 and is rotatably secured to cylinder 68. The upper, unthreaded end 74 of spindle 64 has a longitudinal recess or groove 76. A key screw 78 having a smooth end 80 is threaded into a hole 82 in the side of cylinder 68 near its upper end 84 so that the smooth end 80 of key screw 78 is received in longitudinal groove 76 in spindle 64. This permits spindle 64 to move along its longitudinal axis within micro-adjust cylinder 68 but prevents spindle 64 from rotating within cylinder 68. Because knob 70 is captured on the lower end 86 of cylinder 68, and is also threaded onto the threaded end 74 of spindle 64, rotation of knob 70 causes spindle 64 to move axially within cylinder 68. Because the threads on spindle 64 and in knob 70 are relatively fine, axial motion of spindle 64 in response to a small rotation of knob 70 is modest.

By capturing micro-adjust cylinder 68 in the lower end 69 of mechanism body 20, piston 16 can be permitted to rest on the upper 88 of spindle 64. Thus, rotation of knob 70 causes controlled axial movement of piston 16, and therefore of router bit 14. Micro-adjust cylinder 68 may be captured in mechanism body 20 by squeezing together plates 90 and 92 by tightening threaded stud 94 with gyratory handle 96. Threaded stud 94 passes through a smooth bore 91 in plate 92 and is threaded into a threaded hole 93 in plate 90. (Each of gyratory handles 60 and 96 could be replaced by knobs, cam-acting tightening levers, rusty C-clamps or any other mechanism usable to squeeze together the pairs of plates with which they are associated).

As may be seen by reference to FIG. 2, plates 90 and 92 are simply separated from plates 38 and 40 by a lateral cut 98 into body 20, which permits the pair of plates 38 and 40 to be squeezed separately from pair 90 and 92. The head of key screw 78 is received within groove 36 between the pairs of plates 90 and 92 or 38 and 40 when inserting micro-adjust mechanism 60 in body 20.

Figure 8:
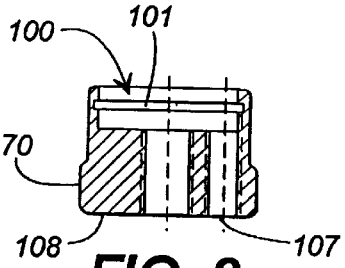
FIG. 8 is a section view taken along lines 8—8 through the micro adjust knob in FIG. 2.

As may be seen by reference to FIG. 8, knob 70 has a large blind bore 100, which receives a disk-shaped portion 102 that projects from the lower end 86 of micro-adjust cylinder 68. Disk 102 is captured in the bore 100 in knob 70 by an internal retaining ring 104 that is received in an annular recess 101 in the wall of bore 100 in knob 70.

Figure 5:
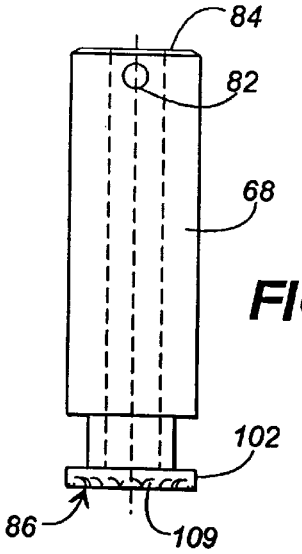
FIG. 5 is a side elevation view of the micro-adjust cylinder of the positioning mechanism shown in FIG. 1.
Figure 7:
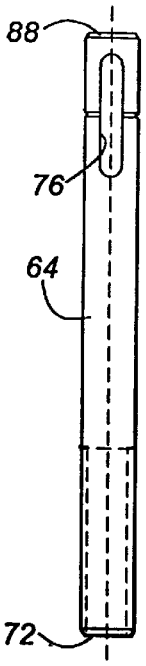
FIG. 7 is a side elevation view of the spindle of the micro-adjust mechanism of this invention.
Figure 6:
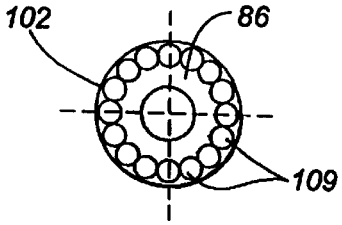
FIG. 6 is a bottom plan view of the micro-adjust cylinder shown in FIG. 5.
Figure 9:
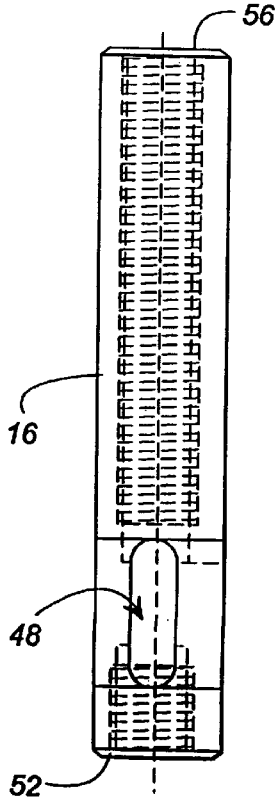
FIG. 9 is a side elevation view of the piston of the positioning mechanism shown in FIG. 1.

Small, predetermined increments of angular rotation of knob 70 are achieved by a interaction between a detent mechanism, such as a ball detent set screw or rod detent set screw 106, and recesses in the lower face or end 86 of disk 102. Ball detent set screw or rod detent set screw 106 is threaded into a threaded hole 107 in the lower face 108 of knob 70 so that the spring loaded end of detent set screw 106 bears against the lower face 86 of disk 102. As shown in FIGS. 5 and 6, the face 86 of disk 102 is machined with sixteen equally spaced spherical cavities 109 that fall under detent set screw 106 as knob 70 is rotated, thereby causing knob 70 to move around cylinder 68 and spindle 64 in angular increments of 22.5 degrees. (Different increments can, of course, be achieved by differently spacing the spherical cavities 109). With a thread pitch of thirty-two threads per inch on knob 70 and spindle 64, each such 22.5 degree rotation of knob 70 will move spindle 64 axially by an increment of 0.002 inch. This permits very precise positioning of bit 14. The detent mechanism 106 could alternatively be positioned in disk 102 while cavities 109 are located in knob 70.

Figure 3:
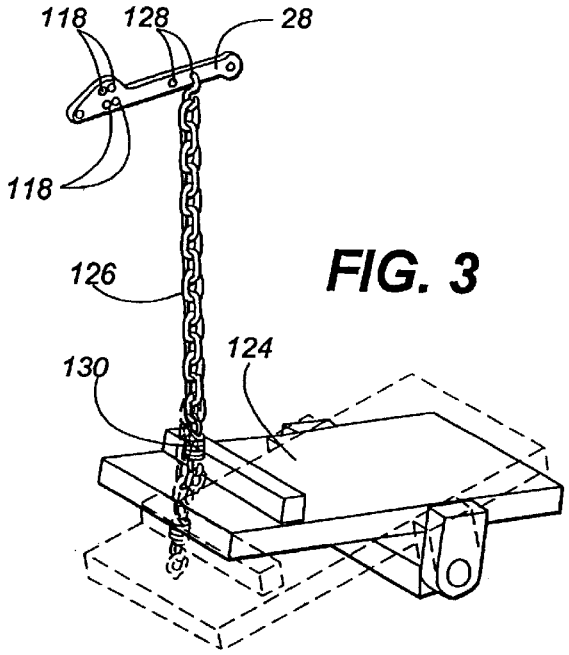
FIG. 3 is a perspective view of the handle of the router bit positioning mechanism of this invention attached to a foot pedal.

In order to use router bit positioning mechanism 10, handle 28 is manipulated using knobs 110 or the foot control illustrated in FIG. 3 and described below preliminarily to position router bit 14 in approximately a desired location. Cylinder 68 of micro-adjust mechanism 60 is then raised within micro-adjust body 20 so that the upper end 88 of spindle 64 abuts set screw 54 in piston 16. Gyratory handle 96 is then rotated so that stud 94 draws plates 92 and 90 together, thereby locking micro-adjust cylinder 68 within body 20. Stud 58 controlled by handle 60 remains loose or is loosened so that piston 16 may slide up and down freely within body 20.

Micro-adjust knob 70 is then rotated until the exact desired position of router bit 14 is achieved. Handle 60 may then be rotated so that stud 58 will draw plates 38 and 40 together, thereby locking piston 16 within body 20 and, consequently, locking router body 26 and router bit 14 in the desired location.

As may best be seen by reference to FIG. 2, handle 28 is penetrated by several holes. Axle hole 112 receives shoulder screw or pivot screw 30 on which handle 28 pivots. Links 34 that attach at their lower ends to piston arm 32 attach, at their upper ends 116, to any of several holes 118 in handle 28.

Multiple holes 118 in handle 28 are provided for two reasons. First, holes 118 at the same radial distance from pivot screw 30 permit handle 28 to assume different positions relative to a given position of piston 16 within body 20. This allows the user of router bit positioning mechanism 10 to accommodate different conditions resulting from the use of mechanism 10 with different routers 12 and router tables, thereby increasing the likelihood that handle 28 can be located in a convenient position without obstructing or encountering other objects. The second reason for multiple holes 118 is that such holes at different distances from pivot screw 30 provide different "sensitivity" for handle 28. Attachment of links 34 to a hole 118 in handle 28 that is closer to pivot screw 30 will mean that handle 28 must pivot through a greater angle to achieve movement of piston 16 (and therefore bit 14) a given distance (but that less force will be required to move handle 28) than if links 34 are attached at a hole 118 in handle 28 that if further from pivot screw 30.

As may be seen by reference to FIGS. 1 and 2, knobs 110 are positioned on opposite ends of a headless set screw 120 that passes through a hole 122 in the end of handle 28 remote from body 20.

As is apparent from FIG. 1, handle 28 can be manipulated by grasping knobs 110. An alternative mechanism for manipulation of handle 28 using a foot pedal is desirable in many instances. Such a foot petal 124 is illustrated in FIG. 3. Foot petal 124 is attached to handle 28 by a chain 126 fixed in one of the holes 128 in handle 28. Base spring 130 may be part of the linkage between handle 28 and foot pedal 124 so that actuation of foot pedal 124 when piston 16 is locked in body 20 will not damage any of the components of positioning mechanism 10.

As will be appreciated by those skilled in the design and use of tools, numerous modifications can be made in router bit positioning mechanism 10 described above that are within the spirit of this invention and that are within the scope of the following claims. For instance, a wide variety of structures other than the one illustrated in the drawings and described above could be used for micro-adjust mechanism 60. Such alternatives included simplified versions of the mechanism described above (omitting, for instance, the detent set screw feature), and alternative approaches could be used, such as geared mechanisms and different screw-containing mechanisms. The principal requirement of any such micro-adjust mechanism 60 is that it provide a relatively easy way to make small adjustments in the position of router bit 14 by making small changes in the position of router body 26 relative to router base 24.

Other changes can likewise be made in other elements of the structure of bit positioning mechanism 10 while achieving the fundamental benefits of this invention: the capacity easily to adjust the position of a plunge router body relative to its base by both substantial and very small amounts, particularly when the router is mounted upside down in a router table, so that the projection of a router bit through a router table can be easily and very accurately adjusted. For instance, the lever-actuated piston described above might instead be a screw arrangement or a rack and pinion gear arrangement, among numerous other alternatives.

Pin Router Arm Mechanism

Figure 10:
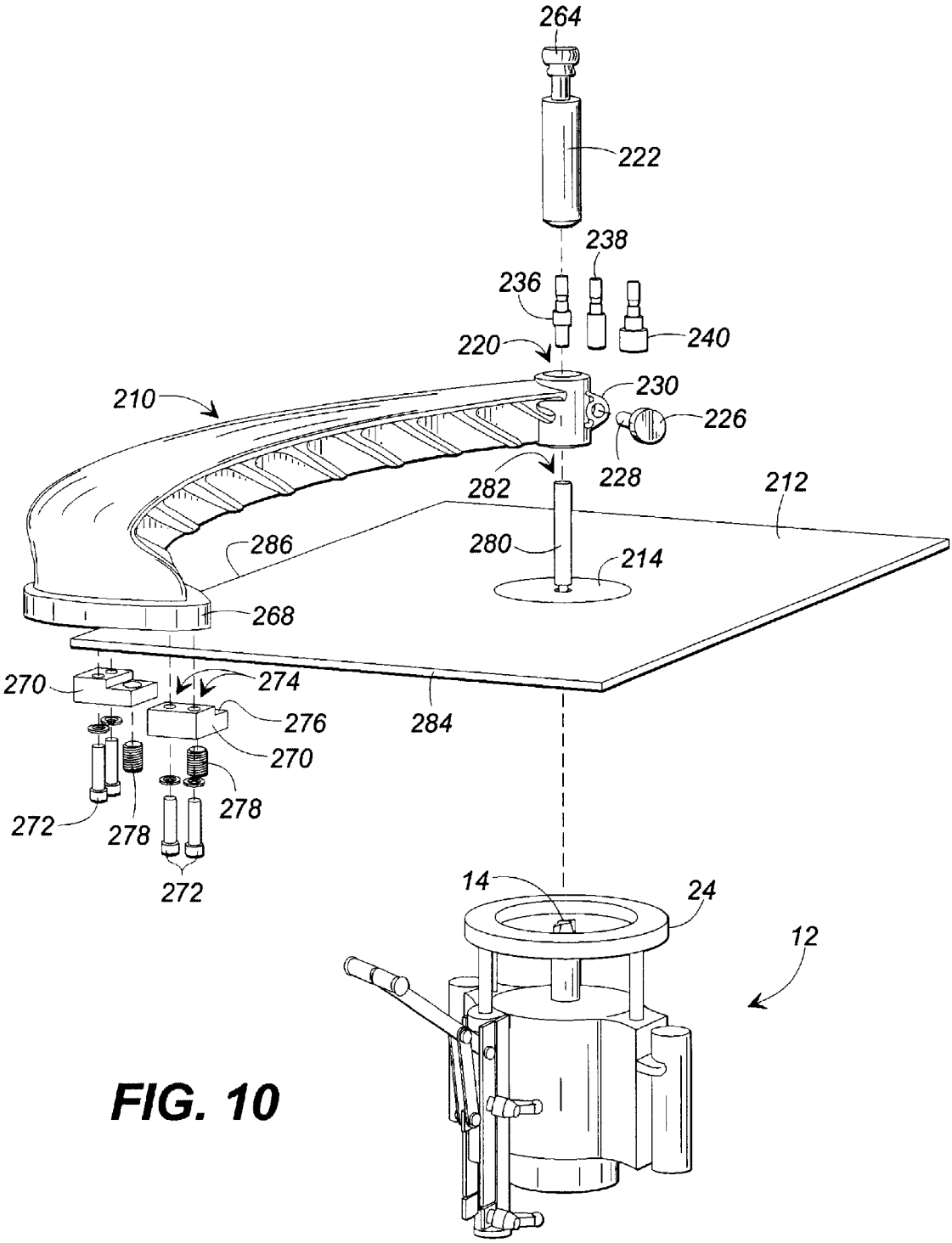
FIG. 10 is an exploded isometric view of the pin router arm and router adjustment mechanism of this invention shown together with a router table top and a conventional plunge router.

FIG. 10 illustrates the router bit positioning mechanism 10 of this invention shown in position on a conventional router 12 together with the pin router arm 210 of this invention and a router table top 212. Router table top 212 and insert 214 may, for instance, be the type of steel table top described in U.S. Pat. No. 5,715,880, but pin router arm 210 and adjustment mechanism 10 may be used with a wide variety of other router tables and table tops, including tops made of wood, composition, plastic, cast iron and other materials.

Figure 11:
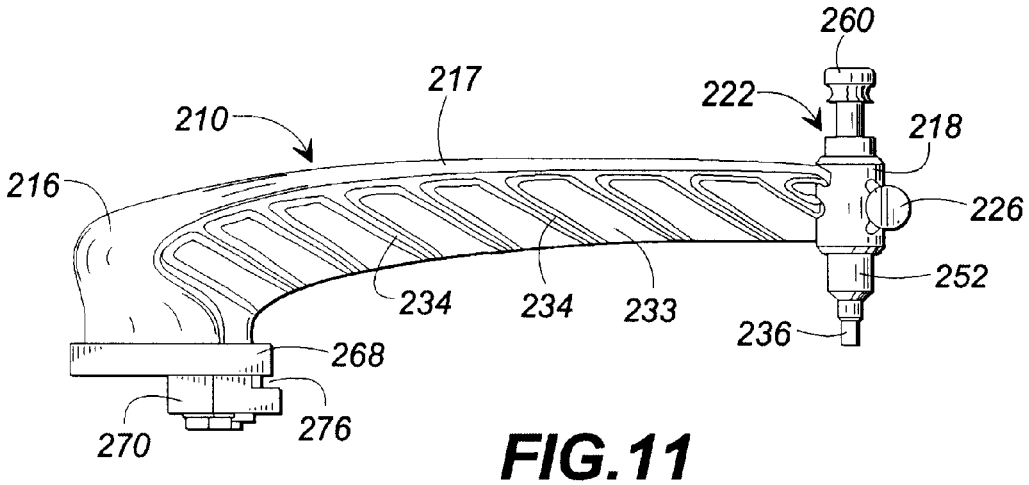
FIG. 11 is a side elevation view of the pin router arm shown in FIG. 10 with the guide pin raised.
Figure 13:
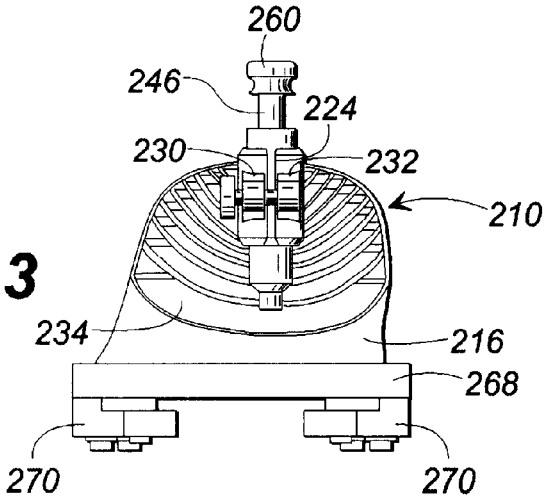
FIG. 13 is an end elevation view of the pin router arm shown in FIG. 10.

As may be appreciated by reference to drawing FIGS. 10, 11 and 13, the principal component of pin router arm 210 is an arm casting 216 that sweeps up from the corner of router table top 212 and terminates in a sleeve 218 that defines a vertical bore 220 within which guide pin mechanism 222 is captured. Sleeve 218 is penetrated by a vertical slot 224 so that an adjustment knob 226 having a threaded shaft 228 that passes through boss 230 on one side of vertical slot 224 and into boss 232 on the other side of vertical slot 224 can, by tightening knob 226, close bore 220 to capture guide pin mechanism 222. Casting 216 has a back 217 and gains strength and rigidity from a longitudinal spine web 233 and transverse plates or ribs 234. Arm casting 216 may be manufactured as illustrated in the figures of 356.1 alloy aluminum. Other usable materials (depending on the details of the design) include zinc-aluminum alloy (such as ZA-12), cast iron, steel, reinforced polymeric material such as glass filled nylon, or of any of a variety of other materials providing sufficient strength, rigidity, and durability.

Guide pin mechanism 222 holds a guide pin 236, 238 or 240 so that it is directly above and has its longitudinal axis coaxial with the axis of rotation of router bit 14. Guide pins 236, 238 and 240 shown in the figures illustrate alternative diameters of guide pins that are interchangeably usable in guide pin mechanism 222. Each guide pin 236, 238 or 240 is captured in guide pin mechanism 222 by trapping guide pin 236, 238, 240 shank 242 in a bore 244 in guide pin shaft 246. Shank 242 is captured in shaft 246 with a set screw 248 that threaded into shaft 246 and is received in an annular groove 250 in shank 242 of the guide pin.

Figure 12:
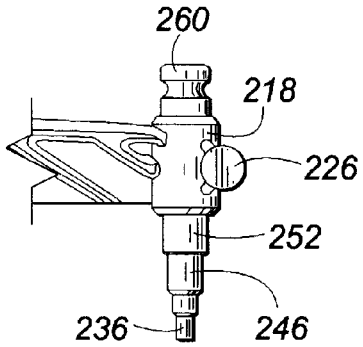
FIG. 12 is a fragmentary side elevation view of the pin router arm shown in FIG. 11 with the guide pin lowered.
Figure 14:
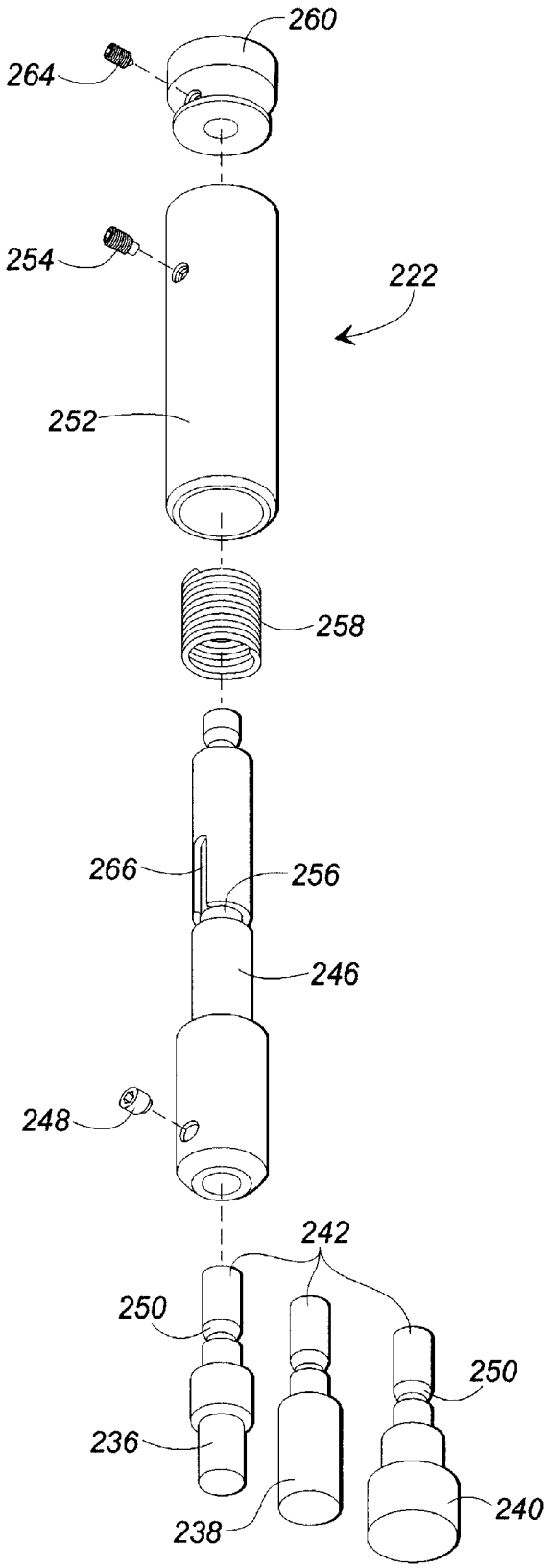
FIG. 14 is an exploded isometric view of the guide pin mechanism shown in FIG. 10.
Figure 15:
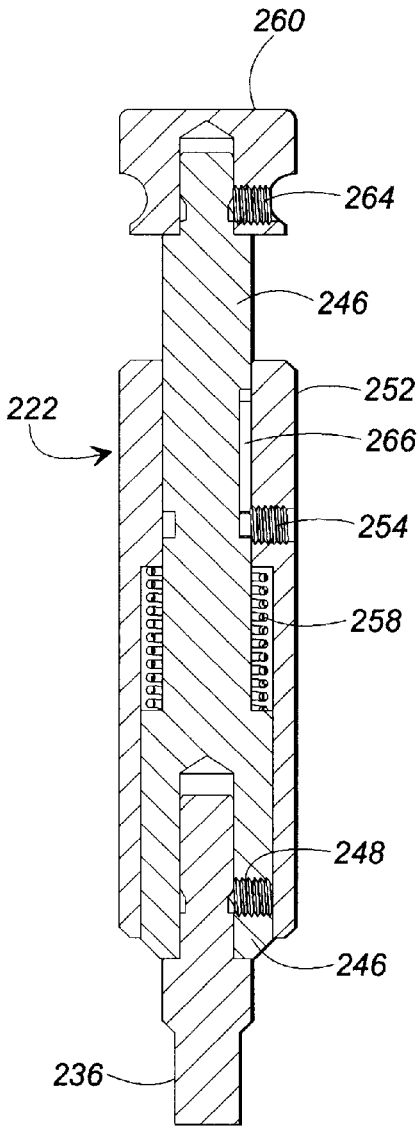
FIG. 15 is a side elevation view, in section, taken though the longitudinal axis of the guide pin mechanism shown in FIG. 10.
Figure 16:
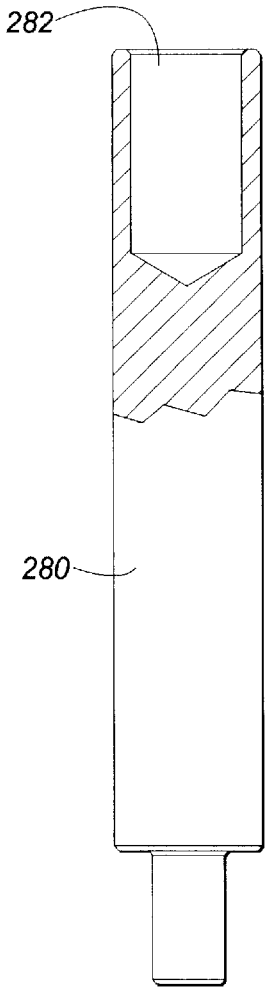
FIG. 16 is an enlarged side elevation view, partially in section, of the centering pin shown in FIG. 10.
Figure 17:
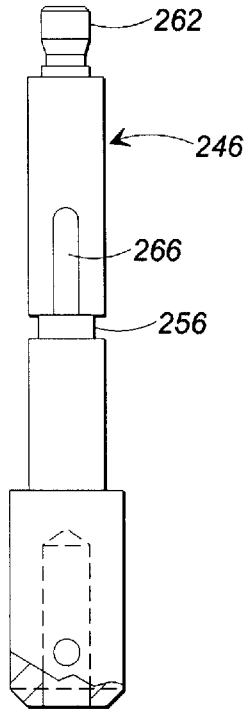
FIG. 17 is a side elevation view of the shaft portion of the guide pin mechanism shown in FIG. 10.
Figure 18:
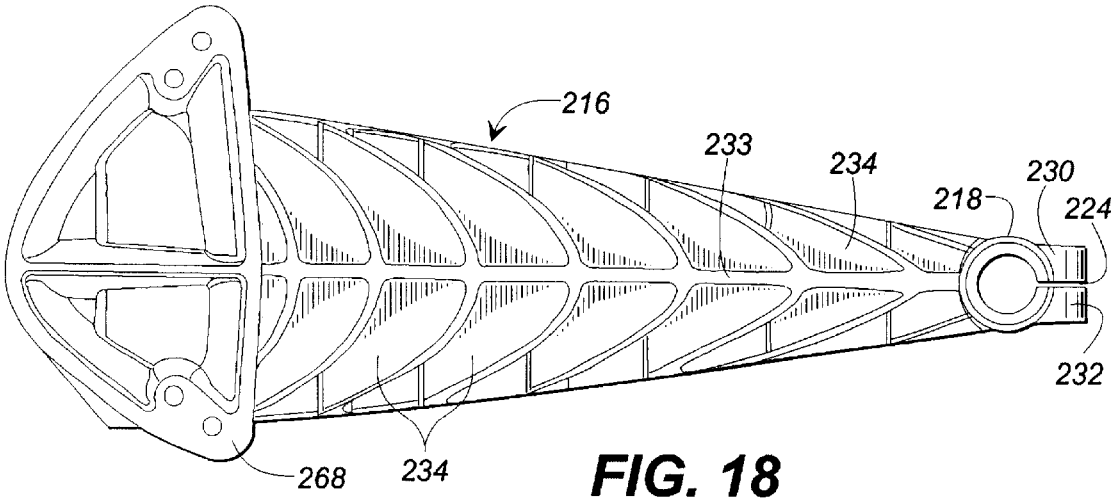
FIG. 18 is a bottom plan view of the arm casting portion of the arm assembly shown in FIGS. 10 and 11.

As will be appreciated, in particular, by reference to FIGS. 14 and 15, shaft 246 telescopes up and down within guide pin mechanism housing 252. In the lower position, illustrated in FIG. 12, guide pin 236 is positioned for operation. In the upper position illustrated in FIG. 11, guide pin 236 is raised out of the way in order to make adjustments to the position of router bit 14 or, for instance, in order to position or remove a pattern and workpiece assembly. As will be appreciated by comparison of FIGS. 14 and 15, shaft 246 and the attached guide pin 236, 238 or 240 is retained in the raised position (illustrated in FIGS. 11 and 15) when the dog point of a half dog point set screw 254 threaded into housing 252 is received in annular groove 256 in shaft 246. This causes coiled compression spring 258 to be compressed. If shaft 246 is rotated, however, utilizing knob 260 locked to the top end 262 of shaft 246 with set screw 264, half dog point set screw 254 will be aligned with the vertical groove 266 in shaft 246. This will allow shaft 246, urged by spring 258, to drop to the lower position illustrated in FIG. 12, at which position knob 260 seats against housing 252.

As noted above, pin router arm 210 may be bolted to the upper surface of a table top 212 with bolts that pass through the table top and into the base 268 of arm 210. Alternatively and preferably, arm 210 may be clamped to the corner of a router table top 212 utilizing two generally L-shaped clamping blocks 270. Each clamping block 270 is bolted to the bottom of base 268 with one or two bolts 272 that pass through oval or otherwise enlarged holes 274 in clamping blocks 270. The rabbet 276 in each clamping block 270 is deep enough to receive router table top 210 loosely when clamping blocks 270 are bolted to base 268. After the clamping blocks are properly positioned on base 268 so that the bore 220 is coaxial with bit 14, arm 210 is fixed in position on router table top 212 utilizing set screws 278 that pass through clamping blocks 270 and bear against the underside of table top 212.

Pin router arm 210 is positioned, in the first instance, on router table top 212 as follows. A centering pin 280 is positioned in the collet of router 12 so that it projects above router table top 212 as is illustrated in FIG. 10. The projecting portion of centering pin 280 is desirably (but need not be) equal in diameter to one of the guide pins, such as guide pin 238 and, preferably, has a coaxial bore 282 in the upper end of centering pin 280 equal in diameter to a smaller guide pin, such as guide pin 236. The collet end of centering pin 280 may be stepped, such as ¼ and ½ inch in diameter, to fit conventional collet diameters. With guide pin mechanism 222 positioned in bore 220, arm 210 is positioned so that guide pin mechanism 222 is coaxial with centering pin 280 as, for instance, by receiving guide pin 236 in bore 282 in centering pin 280. Guide blocks 270 are then positioned on the base 268 so that they lie against adjacent edges 284 and 286 of table top 212. With all parts properly aligned, bolts 272 are then tightened to fix the position of guide blocks 270 on base 268. Arm 210 can then be locked in place utilizing set screws 278 and temporarily removed by loosening set screws 278.

As will be appreciated by individuals familiar with the utilization of conventional pin routing machines, the apparatus of this invention can be used with appropriately chosen diameter guides and cutters to manufacture a wide variety of products. A variety of materials can be used to fabricate the above-described components of this invention, including steel, aluminum, brass, metal alloys and other appropriate materials. For instance, among other materials, steel can be used for the centering pin 280, housing 252 and shaft 246. Steel, aluminum and brass, among other materials such as plastics, could be used for knobs 260 and 226. Steel, aluminum, brass and other materials could be used for guide pins 236, 238 and 240. A ball bearing could be mounted on each guide pin to bear against the pattern with which it is used for reduced pattern wear. Clamping blocks 270 could be manufactured of aluminum, steel and other materials, and spring 258 can be fabricated of music wire.

Thus, numerous modifications of the pin router arm 210 of this invention can be made that are within the spirit of this invention and the scope of the following claims.

What is claimed is:

1. Apparatus for use with a router, a router bit and a router table to provide pin router capabilities, the apparatus comprising:

(a) a guide pin mechanism for holding a guide pin in either a raised or lowered position, (b) an arm for attachment to the router table and for holding the guide pin mechanism above the router table in multiple positions along an axis normal to the router table top, wherein the arm holds the guide pin mechanism in a collar closable about the guide pin mechanism with a locking knob attached to a threaded shaft.

2. Apparatus for use with a router, a router bit and a router table to provide pin router capabilities, the apparatus comprising:

(a) a guide pin mechanism for holding a guide pin in either a raised or lowered position, wherein the guide pin mechanism comprises:

(i) a shaft having top and bottom ends and a bore in the bottom end within which a portion of the guide pin is received, and (ii) a tubular housing having a longitudinal bore within which the shaft is secured to move between the raised and lowered positions, (b) an aim for attachment to the router table and for holding the guide pin mechanism above the router table in multiple positions along an axis normal to the router table top.

3. The apparatus of claim 2, further comprising a knob on the top end of the shaft to manipulate the shaft between the raised and lowered positions.

4. The apparatus of claim 2, further comprising a pin secured in one of the housing or the shaft, a portion of which pin rides in connected annular and vertical grooves in the other of the shaft or the housing so that the shaft is held in the raised position when the pin portion is in the annular groove and the shaft can drop to the lower position when the pin portion is in the vertical groove.

5. The apparatus of claim 2, further comprising a spring for urging the shaft toward the lower position.

6. Apparatus for use with a router, a router bit and a router table to provide pin router capabilities, the apparatus comprising:

(a) an arm for attachment to the router table, (b) at least one clamp for securing the arm to the router table, and (c) at least one adjustable stop for repeatably positioning the arm on the router table in a desired location.

7. The apparatus of claim 6, wherein the at least one clamp comprises:

(a) two clamp blocks, each having a generally L-shaped cross section, (b) at least one first fastener for securing each clamp block to the router table arm in multiple positions so that the clamp blocks act as stops against the edge of the router table to properly position the arm relative to the table, and (c) at least one second fastener for exerting pressure against the router table to secure the arm to the top.

* * * * *